US009969157B1

(12) United States Patent
Linn et al.

(10) Patent No.: US 9,969,157 B1
(45) Date of Patent: May 15, 2018

(54) FLUIDIC DIE

(71) Applicant: HEWLETT-PACKARD DEVELOPMENT COMPANY, L.P., Houston, TX (US)

(72) Inventors: Scott A. Linn, Corvallis, OR (US); George H. Corrigan, III, Corvallis, OR (US); Michael W. Cumbie, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/665,560

(22) Filed: Aug. 1, 2017

Related U.S. Application Data

(63) Continuation of application No. PCT/US2017/042330, filed on Jul. 17, 2017.

(51) Int. Cl.
*B41J 2/045* (2006.01)
*B41J 2/14* (2006.01)
*B41J 2/21* (2006.01)

(52) U.S. Cl.
CPC ..... *B41J 2/04573* (2013.01); *B41J 2/0452* (2013.01); *B41J 2/14016* (2013.01); *B41J 2/14024* (2013.01); *B41J 2/14129* (2013.01); *B41J 2/14201* (2013.01); *B41J 2/2125* (2013.01); *B41J 2002/14362* (2013.01)

(58) Field of Classification Search
CPC ..... B41J 2/0452; B41J 2/04573
See application file for complete search history.

(56) References Cited

U.S. PATENT DOCUMENTS

| | | | | |
|---|---|---|---|---|
| 6,280,012 | B1 | 8/2001 | Schloeman | |
| 6,318,828 | B1 * | 11/2001 | Barbour | B41J 2/0451 347/11 |
| 6,575,548 | B1 | 6/2003 | Corrigan, III et al. | |
| 6,726,300 | B2 | 4/2004 | Schloeman | |
| 8,757,750 | B2 | 6/2014 | Banerjee | |
| 9,505,210 | B2 | 11/2016 | Otsuka et al. | |
| 2003/0202025 | A1 * | 10/2003 | Schloeman | B41J 2/04543 347/12 |
| 2007/0153036 | A1 | 7/2007 | Akama | |
| 2016/0067963 | A1 | 3/2016 | Van et al. | |

FOREIGN PATENT DOCUMENTS

| | | | |
|---|---|---|---|
| EP | 674993 | A2 | 10/1995 |
| EP | 1029674 | A2 | 8/2000 |
| GB | 2316513 | | 2/1998 |
| WO | WO2016/068888 | | 5/2016 |

OTHER PUBLICATIONS

Rembe, C., et al; "Thermal Ink Jet Dynamics: Modeling, Simulation and Testing"; Mar. 17, 2000 < http://www.sciencedirect.com/science/article/pii/S0026271499002334 >.

* cited by examiner

*Primary Examiner* — Kristal Feggins
*Assistant Examiner* — Kendrick Liu
(74) *Attorney, Agent, or Firm* — Fabian VanCott

(57) ABSTRACT

A fluidic die may include a number of actuators. The number of actuators form a number of primitives. The fluidic die may include a digital-to-analog converter (DAC) to drive a number of the delay circuits. The delay circuits delay a number of activation pulses that activate the actuators associated with the primitives to reduce peak power demands of the fluidic die. A number of delay circuits may be coupled to each primitive.

13 Claims, 9 Drawing Sheets

FLUIDIC DIE

BACKGROUND

A fluid ejection printing system includes a printhead, a fluid supply which supplies fluid such as ink to the printhead, and a controller to control the printhead. The printhead may eject fluid through a plurality of orifices or nozzles toward a print medium, such as a sheet of paper, in order to print the fluid onto the print medium. The orifices may be arranged in a number of arrays such that property sequenced ejection of ink from the orifices causes characters or other images to be printed upon the print medium as the printhead and the print medium are moved relative to each other.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
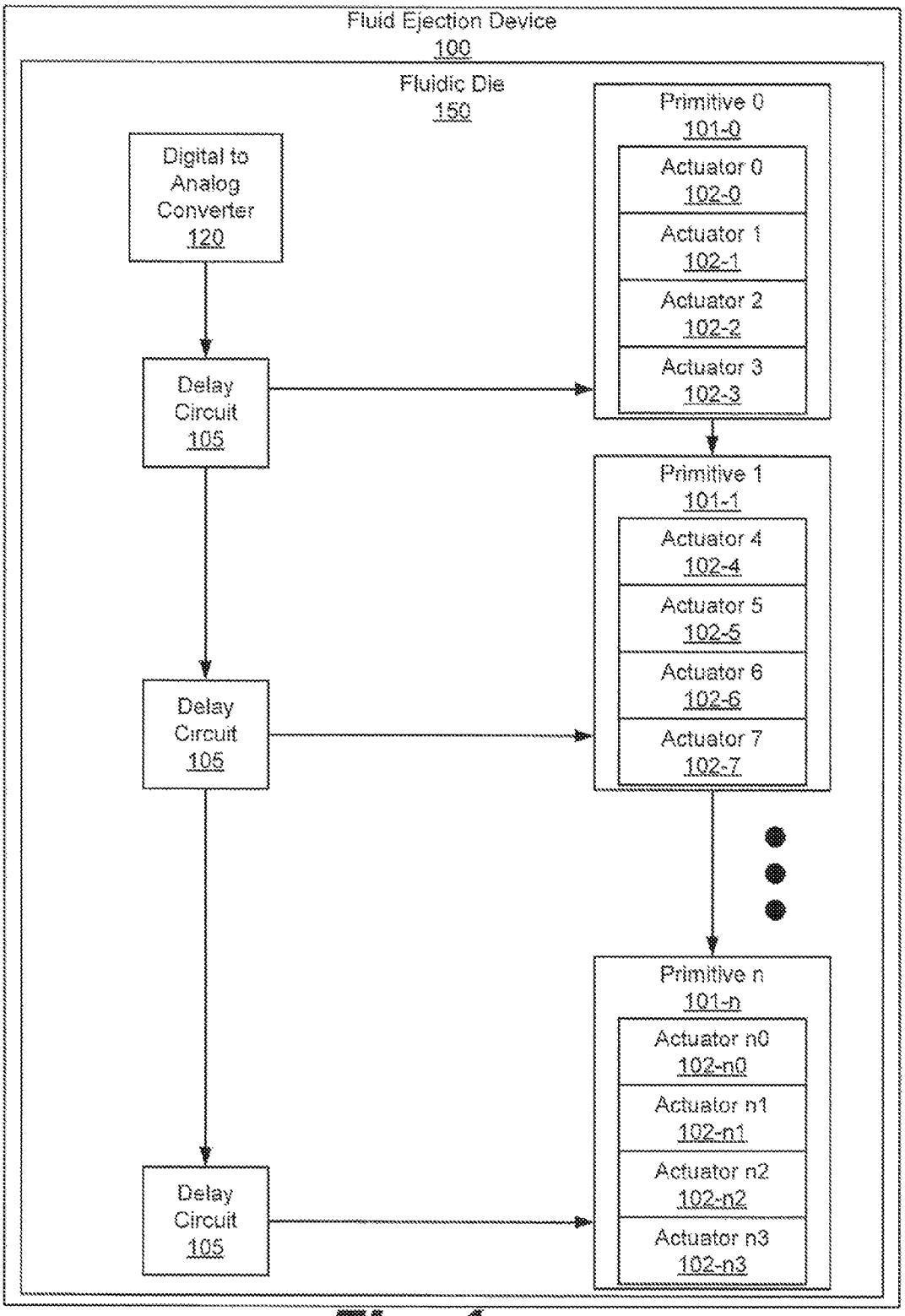
FIG. 1 is a block diagram of a fluid ejection device, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In one example, a printhead may eject the fluid through the nozzles by activating a number of fluid actuators. In one example, the fluid actuators may include thermal resistive devices that rapidly heat a small volume of the fluid located in vaporization chambers to cause the fluid to vaporize and be ejected from the nozzles. In another example, the fluid actuators may include piezoelectric materials located in a number of fluid chambers that change their shape when an electric field is applied to them to increase pressure within the fluid chambers forcing the fluid from the fluid chambers.

To activate the fluid actuators, power is supplied to the fluid actuators. Power consumed by the fluid actuators may be equal to Vi, where V is the voltage across the fluid actuators and i is the current through the fluid actuators. The electronic controller, which is may be located as part of the processing electronics of a printing device, controls the power supplied to the fluid actuators from a power supply which is external to the printhead.

In one type of fluid ejection printing system, printheads receive activation signals including a number of activation pulses from the controller. The controller controls the drop generator energy of the printhead by controlling the activation signal timing. The timing related to the activation signal includes the width of the activation pulses and the point in time at which the activation pulse occurs. The controller may also control a drop generator energy by controlling the electrical current passed through the fluid actuators by controlling the voltage level of the power supply.

Printheads may include a plurality of fluid actuators used to eject the fluid from the printhead, and these fluid actuators may be grouped together into a plurality of primitives. In one example, the number of fluid actuators in each primitive may vary from primitive to primitive. In another example, the number of fluid actuators may be the same for each primitive.

Each fluid actuator includes an associated switching device such as, for example, a field effect transistor (FET). In one example, a single power lead provides power to each FET and fluid actuators in each primitive. In one example, each FET in a primitive may be controlled with a separately energizable address lead coupled to the gate of the FET. In another example, each address lead may be shared by multiple primitives. The address leads are controlled so that only one FET is switched on at a given time so that at most a single actuator in a primitive has electrical current passed through it to cause the fluid in the corresponding chamber to eject fluid at the given time. In one example, the primitives may be arranged in the printhead in rows and columns. There may exist be any number of columns of primitives and any number of rows of primitives within the printhead.

Each fluid actuator in a primitive may be assigned an address. In most circumstances, only one fluid actuator per primitive is actuated at a time, based on the address provided to the primitive. When an activation pulse is conveyed to a column of primitives, that activation pulse may be delayed between primitives or primitive groups using primitive delay devices. These primitive delay elements may be used to offset when actuators and their associated nozzles in a column activate. The delay elements may also be used to decrease noise, maximum time rate of change of the current (dI/dt), and ground rise. The delay time may be either digital or analog in nature.

This delay reduces peak currents and the maximum dI/dt in order to avoid over-burdening the power supply to the printhead and in order to provide enough power to each actuator within the printhead. The primitive delays also act as a type of virtual primitive where it acts as an unactuated or "off" primitive, resulting in the maximum number of primitives that are active or "on" being less. This causes the power consumption to be limited and reduces peak current within the printhead or fluidic die. One cost to causing the printhead to utilize the primitive delays is that the activation pulse takes longer to get to the bottom of the column of primitives and complete the activation pulse for all the primitives in the column. This equates to being unable to complete a print job as fast as may otherwise be possible since a subsequent or next activation pulse cannot initiate at the first or top primitive until activation has initiated in the bottom primitive for the previous activation event. Consequently, in some systems, the maximum activation frequency may be limited by the time it takes for the activation pulse to propagate down the column of primitives. In other words, a trade off may be made between dl and dt. The dl/dt is decreased due to the current (l) going down while time (T) is increasing. In this manner, t may be tailored to a desired value to maximize performance.

In some cases, a digital delay circuit that utilizes a synchronous clock signal from a fire clock may be used to provide a delay between the primitives. However, inclusion of a clock device in the printhead or on the die results in either limited remaining space on the die, or causes the size of the die to increase to accommodate for the addition of the clock device and other associated hardware. Given that the die may, in some cases, be made of expensive materials such as silicon, and may be extremely difficult and expensive to manufacture, addition of a digital clock may prove economically impermissive. Further, sliver die may be used within the printhead. Sliver die may include a thin silicon, glass, or other substrate having a thickness on the order of approximately 650 micrometers (μm) or less, and a ratio of length to width (L/W) of at least three. Given the very small dimensions of such sliver die, addition of digital devices may not be feasible. Thus, examples described herein provide an activation pulse delay system that may be included on a die without requiring the die to be expanded in size while reducing peak currents and maximum time rate of change of the current (dl/dt) in order to avoid over-burdening, the power supply to the printhead and in order to provide enough power to each actuator within the printhead. Again, the delay time may be either digital or analog in nature. Utilizing an analog delay over a digital delay may save area on the die as well as take into account different print frequency targets. Compared to, for example, a digital delay system, an analog delay system consumes less area within the column of primitives, even though it may consume at least a portion of area external to the column. This, in turn, allows for less constrained print masks and halftoning masks. In one example, a variable delay may be detected by visual inspection and/or measuring high-side supply voltage (VPP) current.

A delay between activations of the actuators in a column may be used to limit the number of actuators "on" or activated at the same time. In one example, digital delays may be used to accomplish this delay. However, digital delays are large in area and if more than one clock cycle is desired for a programmable option, then a digital activation pulse delay system may become very large.

An analog delay may be used instead to alleviate the space issue since an analog activation pulse delay system takes up less space on the die. However, an analog activation pulse delay system may be a "fixed" delay such as a digital delay, and this "fixed" delay may itself vary based on process, voltage, temperature (PVT) integrated circuit fabrication parameters, making the analog activation pulse delay system less useful.

A variable delay element may be used where a number of analog reference voltages or a digital control signal is generated, and routed to the primitives. The delay may be varied based on that analog voltage or digital value. An analog voltage may be effective due to fewer wires than digital inputs. When a method of externally observing this delay is added, plus the ability to write a digital register to change the delay, an external system may program the delay to an optimum value in order to minimize the number of primitives on at the same time, while taking into account the activation frequency desired and PVT. This may represent the most optimal power usage for the system. Further, the digital delay value may be automatically adjusted for temperature by shifting the time based on a locally measured temperature, or based on a die temperature measured by a system controller. A delay resolution may depend on the number of digital bits in the delay register and the size of the associated digital-to-analog converter (DAC) if using an analog voltage based delay element.

Examples described herein provide a fluidic die. The fluidic die includes a number of actuators. The number of actuators form a number of primitives. The fluidic die also includes a digital-to-analog converter (DAC) to drive a number of the delay circuits. The delay circuits delay a number of activation pulses that activate the actuators associated with the primitives to reduce peak power demands of the fluidic die. The fluidic die also includes a number of delay circuits coupled to each primitive.

The DAC is a die-global circuit electrically coupled to the delay circuits of each primitive. The fluidic die may include a number of register bits stored in a data storage device on the fluidic die. The register bits control a signal output by the DAC based on a delay setting for each of the primitives. A number of transistors within each of the delay circuits are tuned to an operating point of the delay circuit based on an output signal of the DAC to calibrate the delay circuits relative to the DAC.

The fluidic die also includes a bias voltage generator coupled to the DAC to provide a bias voltage to the DAC. The bias voltage output by the bias voltage generator is tuned based on the operating point of the delay circuits. A number of compensation devices may be included within the fluidic die to compensate for a number of process, voltage, and temperature (PVT) variations within the fluidic die.

Examples described herein also provide a printing device. The printing device includes a number of fluidic dies. The fluidic dies include a number of actuators. The number of actuators form a number of primitives. The fluidic die may also include a number of delay circuits coupled to each primitive, and a digital-to-analog converter (DAC) to drive a number of the delay circuits. The delay circuits delay a number of activation pulses that activate the actuators associated with the primitives to reduce peak power demands of the fluidic die. A print function is defined through a user interface of the printing device, and the delay circuits delay each primitive based on the defined print function. A length of the activation pulses is based on the number of actuators, the number of primitives, a print function, a print demand, or combinations thereof. The activation pulses may include a pulse train that includes a number of the activation pulses. The sum of the activation pulses forms a total activation energy. The delay circuits and DAC are located on the fluidic dies.

Examples described herein also provide a method of reducing peak power demands of at least one fluidic die. The method includes, with a processing device, determining a primitive delay of the fluidic die based on instructions received from the processing device. The processing device instructs the fluidic die to delay a number of activation pulses for a number of firing actuators within a column of actuator primitives using a number of delay circuits coupled to each primitive and a digital-to-analog converter (DAC) to drive a number of the delay circuits. The method may also include generating an activation pulse for each of the actuator primitives of the fluidic die, and activating, via the activation pulse, a number of actuators associated with the actuator primitives based on the primitive delay.

The method may further include calibrating the delay circuits by tuning a number of transistors within each of the delay circuits to an operating point of the delay circuit based on an output signal of the DAC. A number of register bits may be stored on a data storage device of the fluidic die, and, with the register bits, a signal output by the DAC may be controlled based on a delay setting for each of the primitives. The method may include, with a number of compensation devices, compensating for a number of process, voltage, and temperature (PVT) variations within the fluidic die. In one example, the fluidic die may include a non-volatile memory device such as, for example, a ROM memory device, that returns additional information back to a controller that assist in indicating what kind of delay is necessary.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1 is a block diagram of a fluid ejection device (100), according to an example of the principles described herein. The fluid ejection device (100) may be any device capable of ejecting fluids such as inks from an orifice such as, for example, a nozzle. Although the description herein relates to thermal inkjet or piezoelectric printheads, the descriptions regarding delay of primitives for decreasing current draws on a power source may apply to any device that ejects fluids.

The fluid ejection device (100) may include a number of fluidic die (150). The example of FIG. 1 depicts one fluidic die (150). However, the fluid ejection device (100) may include any number of fluidic die (150). In one example, the fluid ejection device (100) may include a plurality of fluidic die (150) arranged in along a print bar to form an array of fluidic die (150).

The fluidic die (150) may include a number of fluid actuators (102-0, 102-1, 102-2, 102-3, 102-4, 102-5, 102-6, 102-7, **102-*n*0, 102-*n*1, 102-*n*2, 102-*n*3, collectively referred to herein as 102) to eject fluid from the fluidic die (150). The actuators (102) may be any device used to move fluid in a direction or force the fluid through an orifice such as a nozzle. For example, the actuators (102) may be thermal resistive devices, piezoelectric devices, pumps, micro-pumps, micro-recirculation pumps, other ejection devices, or combinations thereof. In one example, each actuator (102) may include a switching device such as a field effect transistor (FET). The FETs may be controlled with a separately energizable address lead coupled to the gates of the FETs. In one example, each address lead may be shared by multiple primitives (101). The address leads are controlled so that only one FET is switched on at a given time so that at most a single actuator (102) in a primitive (101) has electrical current passed through it to activate the actuator (102**) at the given time.

The actuators (102) may be grouped into a number of primitives (101-0, 101-1, **101-*n*, collectively referred to herein as 101). A primitive (101) is any grouping of a number of actuators (102) within an array of actuators (102). In one example, the number of actuators (102) in each primitive (101) may vary from primitive to primitive. In another example, the number of actuators (102) may be the same for each primitive (101) within the fluidic die (150). In the examples described herein, each primitive (101) may include four actuators (102) each. Further, various numbers of primitives (101) are depicted throughout the figures, and ellipses are included in the figures indicate the potential for any number of primitives (101) to be included within the fluidic die (150). Ellipses are used throughout the figures to denote that any number of that element may be included within the fluidic die (150**).

Each fluidic die (150) in the fluid ejection device (100) may include a digital-to-analog converter (DAC) (120) to drive a number of delay circuits (105). The DAC (120) converts a number of digital signals received from, for example, a processing device, into an analog signal, and sends that analog signal onto at least one delay circuit (105). For every fluidic die (150) produced, a different optimal delay may be tuned within its associated DAC (120) to ensure that the DAC's (120) performance is as consistent as possible.

Further, the fluid ejection device (100) and its fluidic die (150) may be instructed to print using different print modes that operate at different frequencies. With these different frequencies, there exists more or less time to spread out the current and reduce the maximum dI/dt. Thus, in one example, the DAC (120) may be tuned to optimize power consumption and power dithering for each print mode individually. In one example, the delay resultant from tuning the DAC (120) and providing its signal to the delay circuit (105) may be maximized in order to lower the maximum dI/dt. In one example, the DAC (120) may be tuned and used as a bias to change a bias point of the delay circuit (105). By tuning the DAC (120) to an optimum bias point for its associated delay circuit (105), an optimal delay may be propagated down the column of primitives (101). This tuning of the DAC (120) calibrates the DAC (120) and the delay circuit (105) to suit that particular fluidic die (150).

FIG. 1 depicts a number of delay circuits (105) on the fluidic die (105); one delay (105) per primitive (101). However, the fluidic die (150) may include any number of delay circuits (105), and, in one example, may include a plurality of delay circuits (105) within a column of the primitives (101). In one example, a set of a plurality of delay circuits (105) may be included between each primitive (101) to provide instructions to each primitive (101) as the activation pulse used to actuate the actuators (102) is transmitted to each of the primitives (101) as to what degree the activation pulse is to be delayed. The delay circuits (105) may be any device or circuit that delays the primitives' (101) use of the activation pulse or otherwise alters the timing at which a subsequent primitive (101) and its actuators (102) begin to activate. In one example, the delay circuits (105) may cause a delay between activation of the primitives (101) of approximately 22 nanoseconds (ns) per delay circuit (105) with a cumulative delay within a column of primitives (101) being approximately between 1.5 and 3 microseconds (us).

In an example where one delay circuit (105) is used as depicted in FIG. 1, the DAC (120) supplies an analog signal to the delay circuit (105), and the delay circuit supplies that signal to a first primitive (101-0) in the column of primitives (101). Once the first primitive (101-0) has utilized that signal, the first primitive (101-0) may propagate the signal to the next primitive (101-1) and so on until the last primitive (**101-*n*) has received the delay signal. The activation pulse activates each of the actuators (102) associated with the primitives (101) as instructed by a processing device (103). The activation pulses are delayed between the primitives via at least one delay circuit (105) to reduce peak power demands of the fluidic die. In this manner, the delay circuits (105) delay a number of activation pulses that activate the actuators (102) associated with the primitives (101) to reduce peak power demands of the fluid ejection device (100), and a, in one example, number of delay circuits (105**) may be coupled to each primitive.

In all the examples, however, the DAC (120) is a die-global circuit that is electrically coupled to the delay circuit(s) (105) of each primitive (101). As is described in more detail herein, the fluid ejection device (100) may include a number of register bits stored in a data storage device on the fluid ejection device (100). The register bits may be used to control a signal output by the DAC (120) based on a delay setting for each of the primitives (101). A number of transistors within the delay circuit (105) may be tuned to an operating point of the delay circuit (105) based on an output signal of the DAC (120) to calibrate the delay circuits (105) relative to the DAC (120). A bias voltage generator may be coupled to or formed as part of the DAC (120) in order to provide a bias voltage to the DAC (120). This bias voltage output by the bias voltage generator may be tuned based on the operating point of the delay circuit(s) (105). Further, in one example, a number of compensation devices may be included with or within the DAC (120) to compensate for a number of process, voltage, and temperature (PVT) variations within the fluid ejection device (100).

Figure 2:
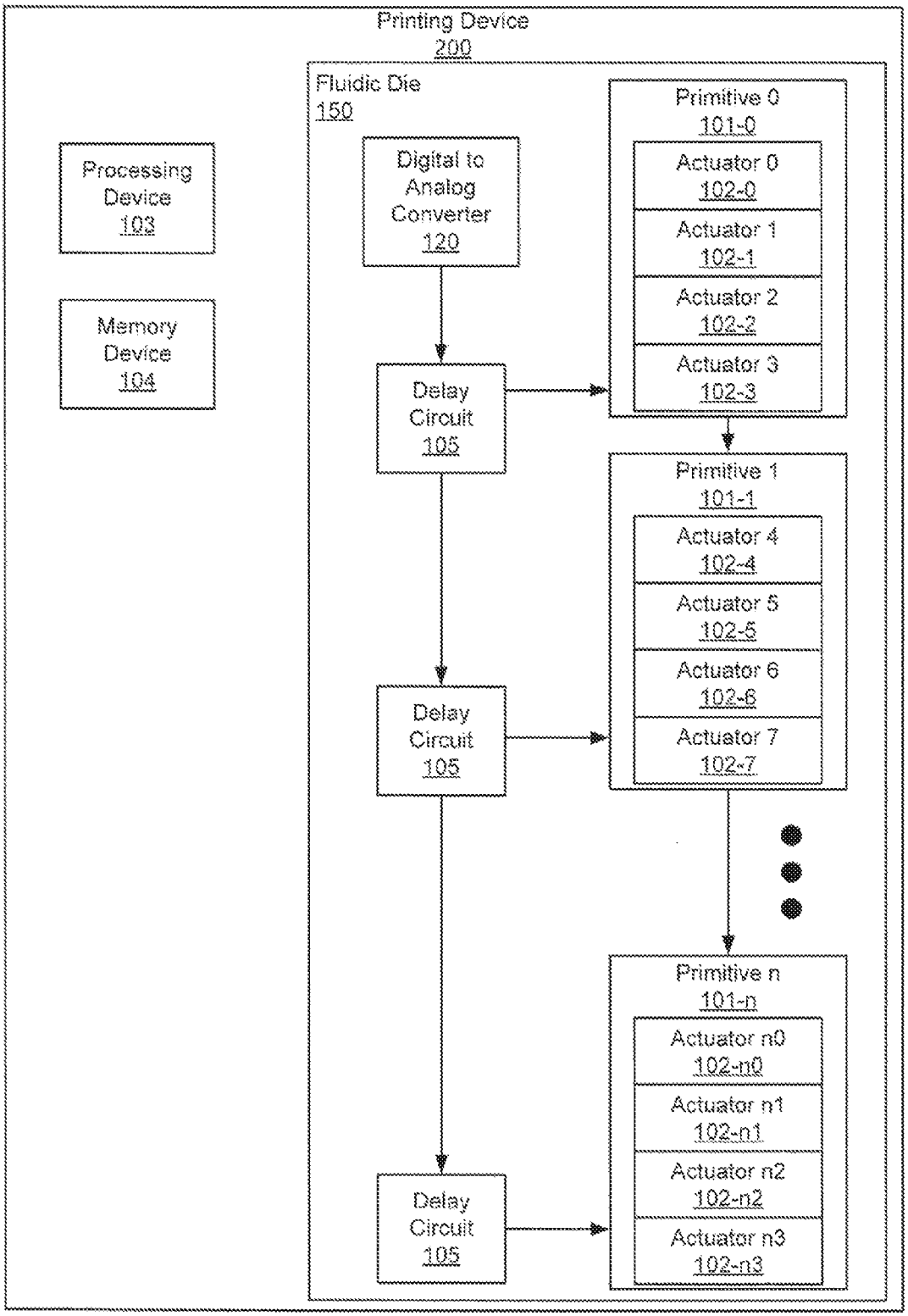
FIG. 2 is a block diagram of a printing device including a number of fluidic die of FIG. 1, according to an example of the principles described herein.

FIG. 2 is a block diagram of a printing device (200) including a number of fluidic die (150) of FIG. 1, according to an example of the principles described herein. Similarly-numbered elements included in FIG. 1 and described in connection with FIG. 1 designate similar elements within FIG. 2. The printing device (200) may include any number of fluidic die (150). Further, the printing device (200) may include a DAC (120) and at least one delay circuit (105). Each fluidic die (100) in the printing device (200) includes at least one delay circuit (105) and the DAC (120) on the fluidic die (100). Because the DAC (120) and the delay circuits (105) are physically small and take up very little space on a fluidic die (100), the DAC (120) and the delay circuits (105) may be manufactured directly on the fluidic die (100) without increasing the size of the fluidic die (100) and, in turn, without increasing the cost to manufacture the fluidic die (100). The DAC (120) and delay circuits (105) may also be included on a sliver die without increasing the size of the sliver die.

The printing device (200) may further include a processing device (103) and a memory device (104). The processing device (103) may control all fluidic die (150) within the printing device (200). The printing device (200) may include a number of fluidic die (150) with each of the fluidic die (150) including a number of actuators (102) to eject fluid from the fluidic die (150).

In one example, the memory device (104) may be located within the printing device (200). In another example, the memory device (104) may be located on the fluidic die (150). The memory device (104) and other memory devices described herein may include various types of memory modules, including volatile and nonvolatile memory. The memory device (104) may include a computer readable medium, a computer readable storage medium, or a non-transitory computer readable medium, among others. For example, the memory device (104) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

In one example, the memory device (104) may store printing modes that include registers that define a temporal delay supplied by the delay circuits (105). In one example, the processing device (103) stores in the memory device (104) the desired printing mode among any number of available print modes in order to obtain a desired temporal delay between the primitives (101) and, as a result, a desired peak or maximum current within the column of primitives (101) and a desired print duration. The fluidic die (150) and the printing device (200) may operate in any number of modes, and these modes may define any number of associated temporal delays that may be, in turn, stored in the memory device (104) and used by the delay circuit (105). In one example, the delay circuits (105) may be analog delays. In another example, the delay circuits (105) may be analog delays where the delay circuits (105) are selected using a digital signal input to the DAC (120), converted to an analog signal. With the memory device (104), a desired temporal delay may be selected prior to printing by the fluidic die (150) of the printing device (200) through programming the delay circuits (105) using the modes stored in the memory device (104).

In one example, a print function or mode may be defined by a user through a user interface of the printing device (200). Printing modes may include, for example, fast draft modes, high quality modes, and photo quality modes, among others. The delay circuits (105) delay each primitive (101) based on the defined print function or mode. For example, the DAC (120) may be provided a digital signal that indicates a fast draft mode, and supplies, based on that digital signal, an analog signal to the delay circuit that biases the delay circuit to create a delay signal for each primitive (101) that is relatively shorter than a delay signal produced for a high quality or photo quality mode.

The length of the activation pulses provided by the DAC (120) and delay circuit (105) to the primitives (101) and their respective actuators (102) may be based on the number of actuators within each primitive, the number of actuators within the fluidic die (150), the number of primitives (101) in the fluidic die (150), a print function, a print demand, a temperature of the fluidic die (150), or combinations thereof. The activation pulses may include a pulse train comprising a number of the activation pulses, wherein the sum of the activation pulses forms a total activation energy.

Figure 3:
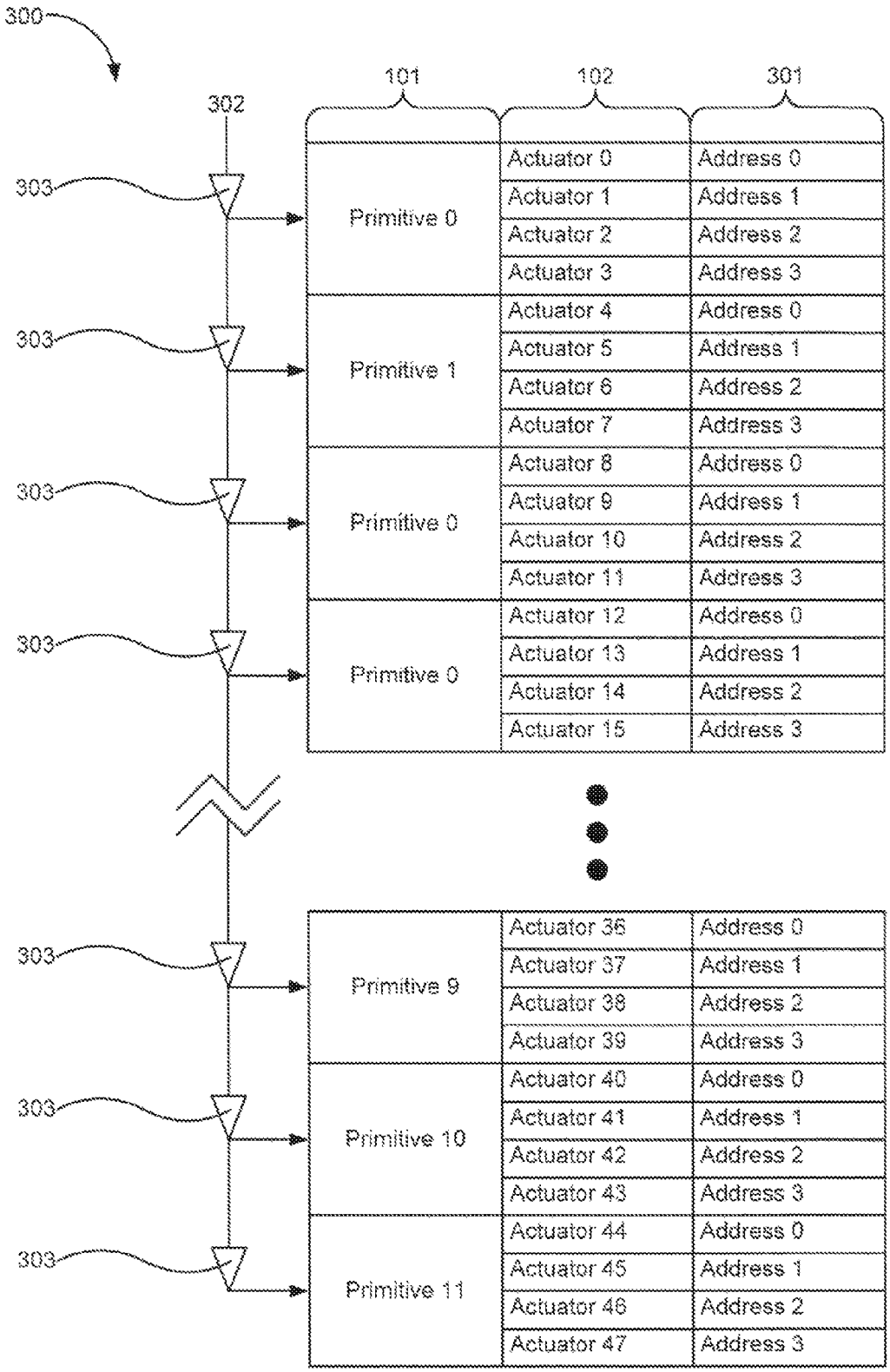
FIG. 3 is a block diagram of a primitive delay design, according to an example of the principles described herein.

FIG. 3 is a block diagram of a primitive delay design (300), according to an example of the principles described herein. Similarly-numbered elements included in FIGS. 1 and 2 and described in connection with FIGS. 1 and 2 designate similar elements within FIG. 3. The primitive delay design (300) may include a number of primitives (101), with each primitive (101) including a number of actuators (102). In order to digitally actuate the actuators (102), each actuator (102) may be assigned an address (301) that is unique to other actuators (102) within its respective primitive (101), is unique to all actuators (102) within the fluidic die (100), or combinations thereof. In one example, one actuator (102) is activated at and given time within a primitive (101). In this example, the address (301) provided to a primitive (101) identifies which of the actuators (102) is activated.

The activation pulse (302) is input at the top of the column of primitives (101). The primitive delay design (300) may also include a number of delay blocks (303), represented by triangles, to selectively send the activation pulse (302) to a given primitive (101) and delay the firing of the actuators (102) within a primitive (101). The delay blocks (303) include the delay circuit (105) as described herein, and each delay circuit (105) is driven by the DAC (120). In this manner, the DAC (120) serves as a die-global circuit that provides analog signals to each delay circuit (105) within the fluidic die (100).

When the activation pulse (302) is conveyed to the column of primitives (101), that activation pulse (302) may be delayed between primitives (101) or primitive groups using the delay blocks (303) in order to reduce peak currents and maximum dI/dt. In the example of FIG. 3, the activation pulse (302) propagates from top to bottom, and each locally delayed activation pulse (302) is conveyed to the associated primitive (101).

In one example, a memory device may be included in each of the primitives (101) in order to allow for a previous activation pulse (302) to propagate to at least the last primitive (101) in the column of primitives (101) while a next or subsequent activation pulse (302) initiates at the first primitive (101) at the top of the column of the primitives (101). However, activation of a top primitive (101) with the next or subsequent activation pulse (302) cannot initiate until activation has initiated in the bottom primitive (101) for the previous activation pulse (302). Consequently, in one example, the maximum activation frequency may be limited by the time it takes for the activation pulse (302) to propagate down the column of primitives (101).

Figure 4:
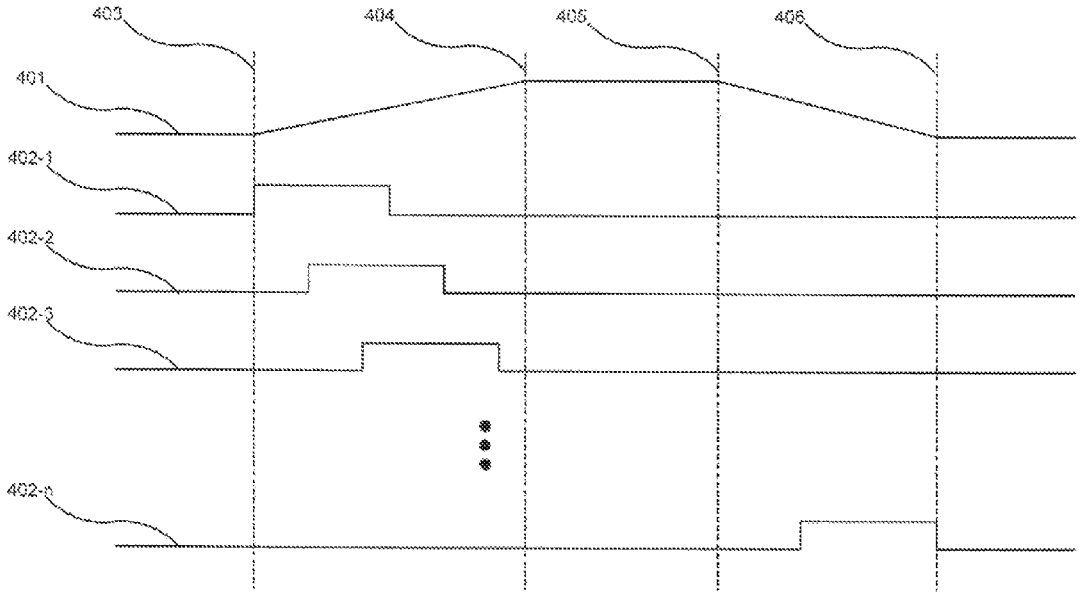
FIG. 4 is a line graph of a total current within a fluidic die during an activation of a number of primitives and in comparison to the activation of the primitives, according to an example of the principles described herein.

FIG. 4 is a line graph of a total current (401) within a fluidic die (100) during an activation of a number of primitives (101) and in comparison to the activation (402-1, 402-2, 402-3, **402-*n*, collectively referred to herein as 402) of the primitives (101), according to an example of the principles described herein. The activation (402) of a number of actuators (102) of the primitives (101) may be performed such that a leading edge of an activation (402-2, 402-3) of a subsequent primitive (101) occurs after and during a prior activation (402-1) of a previous primitive (101) and so on as all the primitives are activated (402-*n*). Thus, at time $t_1$ (403) the current begins to climb as the first (402-1) and subsequent (402-2, 402-3) primitives (101) actuate. Eventually, between $t_2$ (404) and $t_3$ (405), the current plateaus, and after the final few primitives (101) begin to deactivate, the current begins to decrease. The current decreases until the final primitive (101), at $t_4$ (406) completes its activation and deactivates. In this manner, delaying the activation of primitives (101) and their respective actuators (102**) allows for the overall total current to be lower over time.

Figure 5:
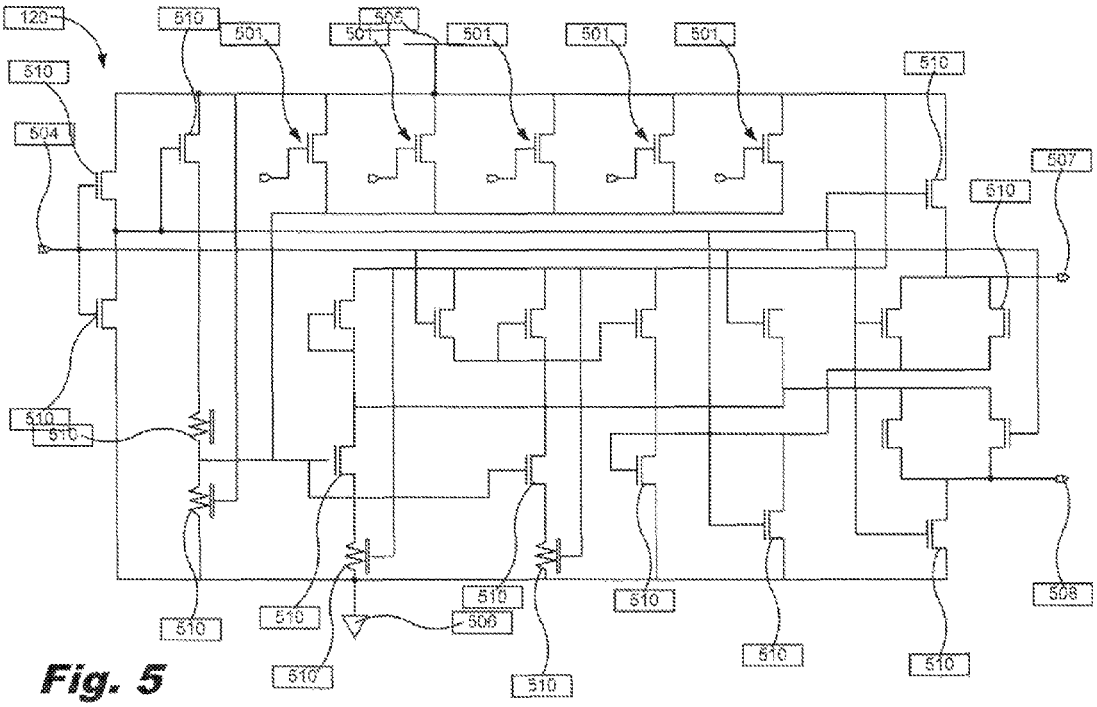
FIG. 5 is a block diagram of a digital-to-analog converter (DAC) and control voltage generator, according to an example of the principles described herein.

FIG. 5 is a block diagram of a digital-to-analog converter (DAC) (120) and control voltage generator, according to an example of the principles described herein. The DAC (120) is used to generate an analog signal with appropriate bias voltages that are tuned to the delay circuit (105). The delay circuit (105) may have an optimal operating point. Thus, the DAC (120) may include a number of calibration bits. (501).

The design of the DAC (120) of FIG. 5 may further decreases the size of the DAC (120) on the fluidic die (100). The DAC (120) may include five calibration bits. (501). Although five bits are included in the example of FIG. 5, any number of bits (501) may be included. It is through these bits that the digital signal is converted to an analog signal and optimized for the delay circuit (105). Further, the DAC (120) may be designed as a fixed-length DAC or a scaled-length DAC depending on the design of the bits of the DAC (120). For example, if the five bits of the DAC (120) are fixed length bits, then the gate area of the bits may consume approximately 1,248 $\mu m^2$ of space on the fluidic die (100). In contrast, if the five bits of the DAC (120) are scaled length bits, then the gate area of the bits may consume approximately 132 $\mu m^2$ of space on the fluidic die (100). Even though an order of magnitude in reduction of size exists between the fixed-length bits and the scaled-length bits, the size of the relatively larger fixed-length example may be sufficiently small such that it does not take up space on the fluidic die (100) to cause the fluidic die (100) to be manufactured larger in size.

An enable signal (504) may be provided to the DAC (120) to enable the DAC (120). A power supply (Vdd) (505) may provide power to the DAC (120). Further, a ground (GND) pin (506) may be included to ground the DAC (120). The DAC (120) may also be referred to as a bias generator since the outputs VCN (507) and VCP (508) of the DAC (120) may be tuned based on the values of the circuit elements (510) such as transistors within the DAC (120) and the of bits (501). Several of the circuit elements (510) of the DAC (120) are identified in FIG. 5. However, any number of circuit elements (510) may be used within the DAC (120) in order to achieve a desired output. The VCN (507) and VCP (508) outputs of the DAC (120) serve as inputs to the delay circuit (105).

Figure 6:
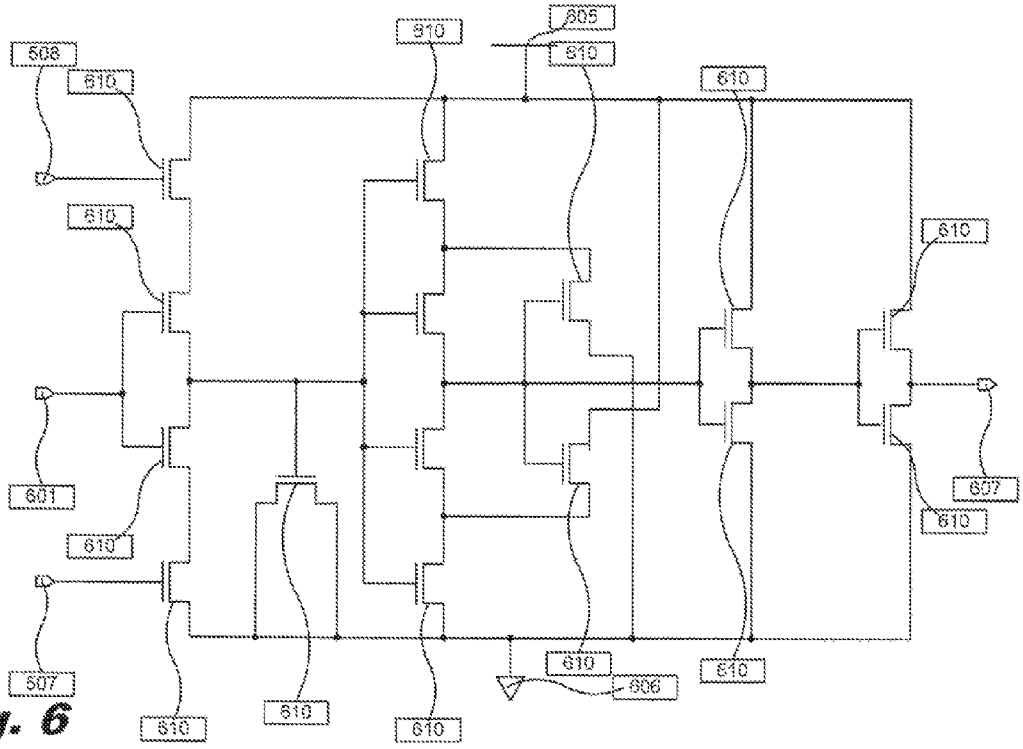
FIG. 6 is a block diagram of a voltage-controlled delay cell, according to another example of the principles described herein.

FIG. 6 is a block diagram of a voltage-controlled delay cell (105), according to another example of the principles described herein. The delay circuit (105) is a voltage-controlled delay cell (105) in that the control is established at VCN (507) and VCP (508) as obtained from the DAC (120). A power supply (Vdd) (605) may provide power to the delay circuit (105). Further, a ground (GND) pin (606) may be included to ground the delay circuit (105). A number of circuit elements (610) may be included within the delay circuit (105). Several of the circuit elements (610) of the delay circuit (105) are identified in FIG. 6. However, any number of circuit elements (610) may be used within the delay circuit (105) in order to achieve a desired output.

The delay circuit (105) may include an enable signal (601) input to enable the delay circuit (105). With the delay circuit (105) enabled, the VCN (507) and VCP (508) inputs may be used to create a delay signal output (607) that is sent to the primitives (101) within the fluidic die (100).

As to FIGS. 5 and 6, the circuit elements (510, 610) may include a number of compensation circuits within the DAC (120) and/or the delay circuit (105) that compensate for a number of process, voltage, and temperature (VPT) variations within the fluidic die (100). These compensation circuits may reduce the range of variability in PVT. For example, if a 10 ns delay was desirable, but the operation of the fluidic die (100) may cause the temperature to increase causing the delay to be pushed over that target 10 ns delay. In this example, a temperature bias circuit may be included within the DAC (120) and/or the delay circuit (105) to compensate for the unexpected rise in temperature. In this manner, the compensation circuits may allow for more margin in providing target delays.

The delays between primitives (101) may be of the order of sub-printing frequencies. In one example, the printing frequency may be between 12 and 48 kilohertz (kHz). Further, there may exist between 10 and 90 primitives (100) within a primitive column on the fluidic die (100).

Figure 7:
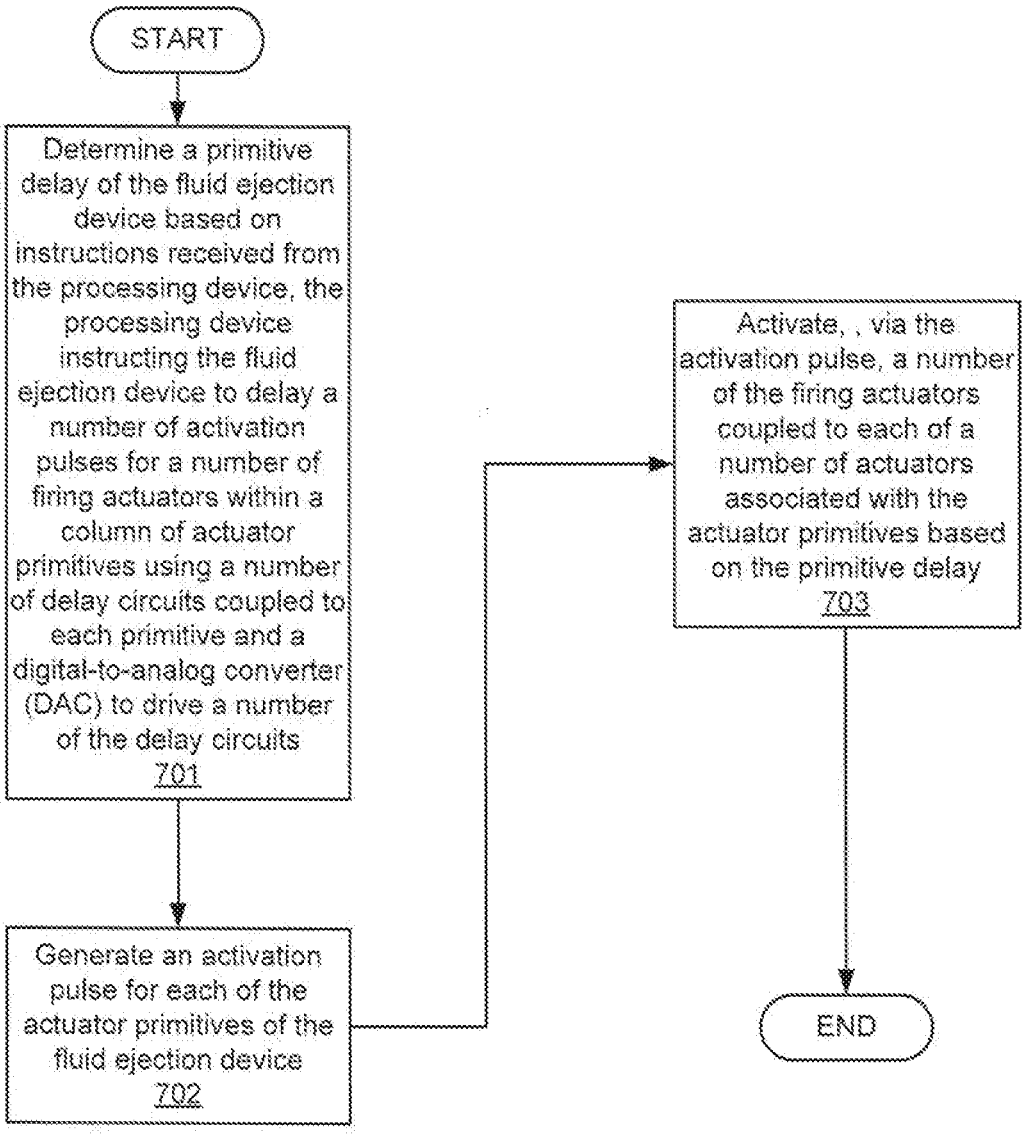
FIG. 7 is a flowchart depicting a method of reducing peak power demands of at least one fluid ejection device, according to an example of the principles described herein.

FIG. 7 is a flowchart depicting a method of reducing peak power demands of at least one fluid ejection device (100), according to an example of the principles described herein. The processing device (103) and the memory device (104) may be used to execute the method of FIG. 7. The method may begin by determining (block 701) a primitive delay of the fluid ejection device based on instructions received from the processing device. The delay may be based on a print mode entered by a user of the printing device (200). The processing device (103) instructs the fluidic die (100) to delay a number of activation pulses for a number of actuators (102) within a column of actuator primitives (101) using a number of delay circuits (105) coupled to each primitive (101) and the DAC (120) to drive a number of the delay circuits (105).

The DAC (120) and delay circuits (105) generate (block 702) an activation pulse for each of the actuator primitives (101) of the fluidic die (100) ejection device. The method may continue by activating (block 703), via the activation pulse, a number of actuators (102) associated with the actuator primitives (101) based on the primitive delay supplied by the DAC (120) and the delay circuits (105).

Figure 8:
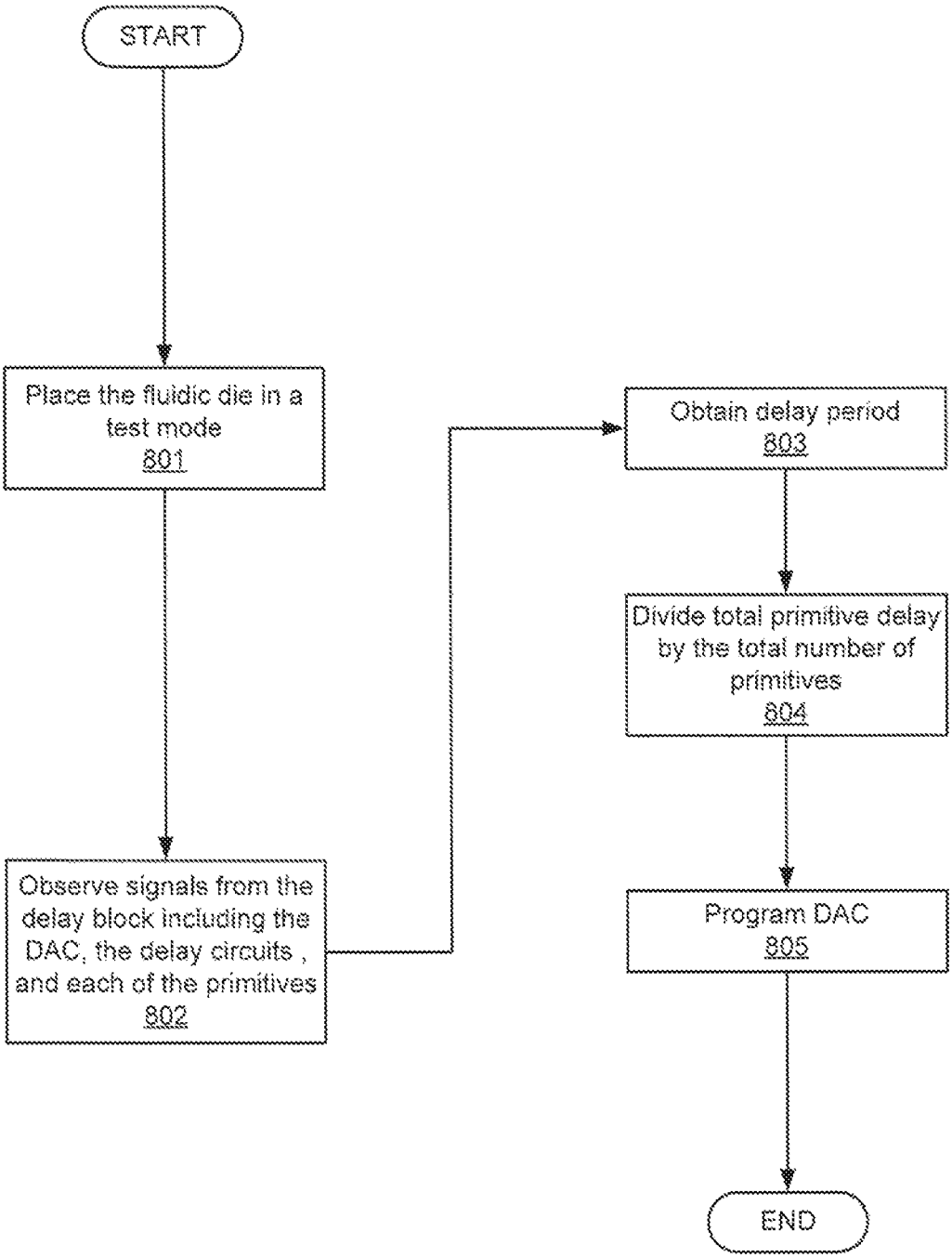
FIG. 8 is a flowchart depicting a method of calibrating a fluidic die, according to an example of the principles described herein.

FIG. 8 is a flowchart depicting a method of calibrating a fluidic die, according to an example of the principles described herein. Each fluidic die (100) may be calibrated with respect to its DAC (120) and delay circuits (105) after manufacture of the fluidic die (100). In performing the calibration, the fluidic die (100) may be placed (block 801) into a test mode, and the signals from the delay block (303) including the DAC (120), the delay circuits (105), and each of the primitives (101) are observed (block 802). In one example, the final output of at least one primitive (101) is observed. Using the test mode, the fluidic die (100) is controlled using a test mode register bit executed by the processing device (103) and stored on the memory device (104). Any electrical pad not being used by the fluidic die (100) may be used to observe the final output delay of the primitives (100).

A print mode may be selected and used as the basis for determining delays within the column of primitives (101) during the calibration. The print mode may define a number of parameters such as, for example, inches per second, print medium speed, temperature of the fluidic die (100), voltages received by the fluidic die (100), and other parameters and defines a maximum operating pulse width space for each activation event of the actuators (102). This may be performed for any number of print modes, and a delay table is created that includes a number of delay values for each print mode. This delay table characterizes the DAC (120) to primitive (101) delay.

The test mode (block 801) instructs the fluidic die (100) to activate at least one of the actuators (102) within the primitives (101). Data regarding the time at which the activation pulse (302) is sent to the fluidic die (100) and the delay at which the fluidic die (100) begins to activate the actuators (102) is stored in the delay table within the memory device (104). The time between the sending of the activation pulse (302) and the time at which the fluidic die (100) begins to activate the actuators (102) may be determined to obtain a delay period. The delay period may be stored in the memory device (104). A number of register bits may be stored on the memory device (104) to control the values output by the DAC (120). Because each fluidic die (100) is calibrated or tuned differently with respect to another fluidic die (100), the memory device (104) may store the register bits. A set of register bits may be stored for each print mode and its corresponding delay values.

Further, the delay period may be obtained (block 803) for each primitive (101) and for all the primitives (101) within the die to obtain individual primitive delays and total delays of all the primitives (101), respectively. The total primitive (101) delay is obtained and that value is divided (block 804) by the total number of primitives (101) in the fluidic die (100) to obtain a per-primitive delay value.

With the identified maximum pulse width (PW) for each print mode and the number of primitives (101) within the column, the number of concurrent primitives (101) being activated or in an on state that results in an optimized fluidic die (100) delay is equal to the maximum pulse width divided by the identified delay. The number of concurrent primitive (101) activations is inversely proportional to the delay value. Thus, the current within the fluidic die (100) will scale in a way that is inversely proportional to the delay in the primitives (101). Once the delay table including delays for all the primitives (101) in each print mode is determined, this value may be used to program (805) the DAC (120). In programming the DAC (120), the delay table is used to determine what digital value is input into the DAC (120) to get a desired and optimized delay from the delay circuits (105). Thus, the DAC (120) may be tuned to output an analog signal for the delay circuit (105) to use in delaying the primitives (101) within the column. Optimizing the delay within the fluidic die (100) using the calibration process may result in a 30% reduction in peak current experienced by the fluidic die (100) during printing. This is done by reducing the number of concurrent primitives (101) activated at a given time.

In one example, the calibration may take place at the time of manufacturing and before an end user obtains the printing device (200) or fluidic die (100). In another example, the calibration may take place when the fluidic die (100) is inserted into a printing device (200) for the first time. In this example, the printing device (200) may use the processing device (103) and the memory device (104) to perform the calibration process and store data regarding the bias. In still another example, calibration may take place before every print job. In yet another example, calibration may take place when the printing device (200) is turned on.

In one example, data regarding the calibration may be stored on the memory device (104) within the printing device (200). The printing device (200) may perform all aspects of the calibration including the measurements associated with the calibration. In this example, the printing device (200) may initiate the calibration process once the fluidic die (100) is electrically coupled to the printing device (200) such as when it is inserted into the printing device (200) in preparation for printing.

Figure 9:
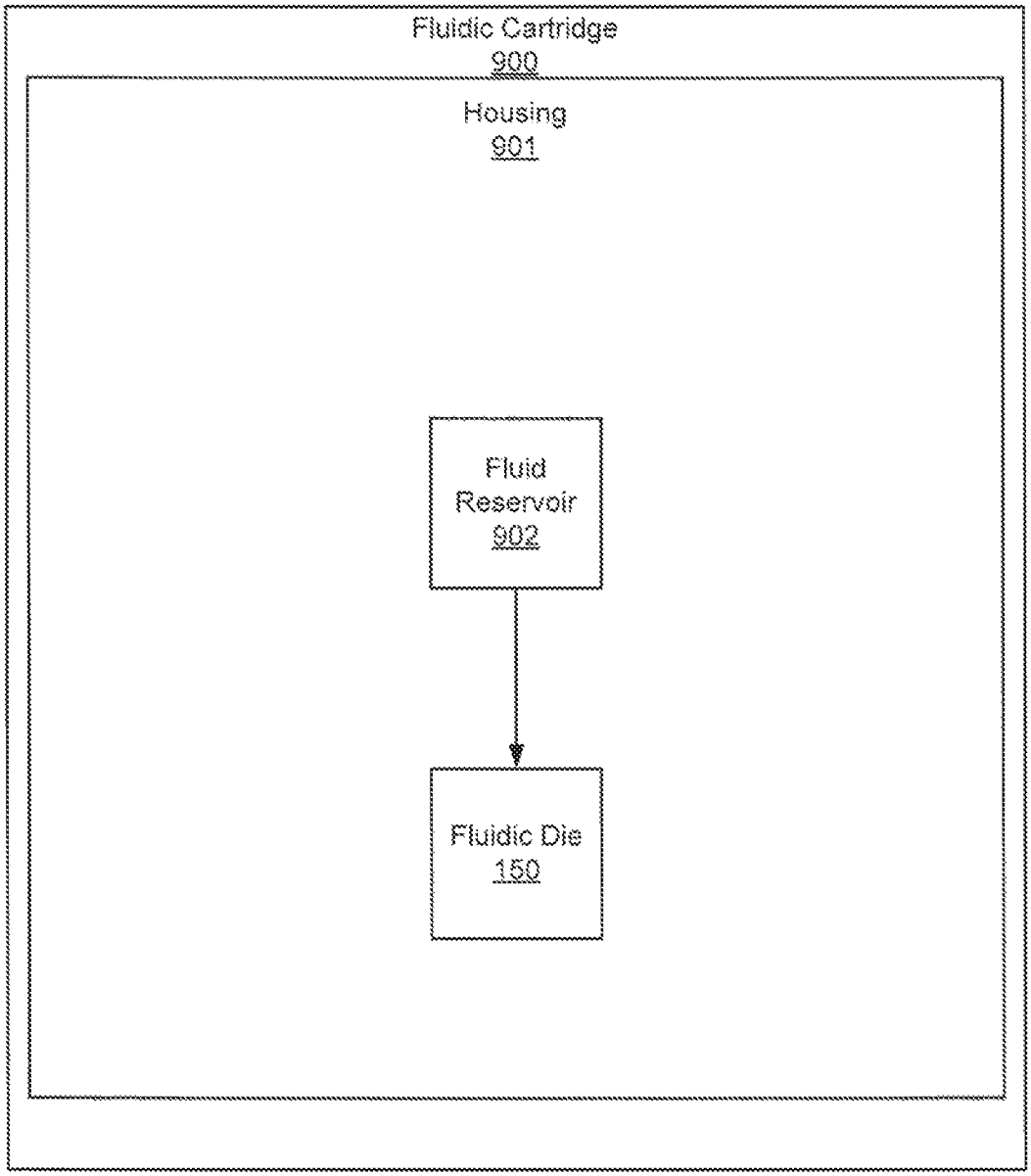
FIG. 9 is a block diagram of a fluid cartridge, according to an example of the principles described herein.

FIG. 9 is a block diagram of a fluid cartridge (900), according to an example of the principles described herein.

In one example, the fluidic die (15) described herein may be included within a fluid cartridge (900) such as, for example, a printer cartridge used to print images onto media. The fluidic cartridge (900) may include a housing (901). The housing (901) houses a fluid reservoir (902) fluidically coupled to the fluidic die (150) described herein. The fluid reservoir (902) supplies the fluidic die (150) with the fluid the fluidic die (150) ejects. The fluidic die (150) includes those elements described herein in order to provide delays that are optimized for a print conditions in order to minimize peak power usage.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, the processing device (103) of the printing device (200) or other programmable data processing apparatus, implement the functions or acts specified in the flowchart and/or block diagram. In one example, the computer usable program code may be embodied within a computer readable storage medium; the computer readable storage medium being part of the computer program product. In one example, the computer readable storage medium is a non-transitory computer readable medium.

The specification and figures describe a fluidic die that may include a number of actuators. The number of actuators form a number of primitives. The fluidic die may include a digital-to-analog converter (DAC) to drive a number of the delay circuits. The delay circuits delay a number of activation pulses that activate the actuators associated with the primitives to reduce peak power demands of the fluidic die. A number of delay circuits may be coupled to each primitive.

The fluidic die may prove primitive delays that are optimized for the exact print conditions in order to minimize peak power usage. This enables a larger fluidic design space including resistor sizes, FET sizes, and power line widths, among others, as well as a larger print mask space and halftone mask space. The fluidic die also provides a very spatially compact activation pulse delay system that consumes little or no additional area on a fluidic die.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic cartridge comprising:

at least one fluidic die comprising:

a plurality of actuators, the actuators forming a number of primitives;

a plurality of delay circuits comprising a delay circuit coupled to each primitive;

a digital-to-analog converter (DAC) to drive the delay circuits, the delay circuits delaying a number of activation pulses that activate the actuators associated with the primitives to reduce peak power demands of the fluidic die; and a data storage device on the fluidic die, the data storage device storing a number of register bits that control a signal output by the DAC based on a delay setting for each of the primitives.

2. The fluidic cartridge of claim 1, wherein the DAC is a die-global circuit electrically coupled to the delay circuit of each primitive.

3. A fluidic cartridge comprising:

at least one fluidic die comprising:

a plurality of actuators, the actuators forming a number of primitives;

a plurality of delay circuits comprising a delay circuit coupled to each primitive;

a digital-to-analog converter (DAC) to drive the delay circuits, the delay circuits delaying a number of activation pulses that activate the actuators associated with the primitives to reduce peak power demands of the fluidic die;

wherein a number of transistors within each of the delay circuits are tuned to an operating point of the delay circuit based on an output signal of the DAC to calibrate the delay circuits relative to the DAC.

4. The fluidic cartridge of claim 3, comprising a bias voltage generator coupled to the DAC to provide a bias voltage to the DAC, the bias voltage output by the bias voltage generator being tuned based on the operating point of the delay circuits.

5. The fluidic cartridge of claim 3, comprising a number of compensation devices to compensate for a number of process, voltage, and temperature (PVT) variations within the fluidic die.

6. The fluidic cartridge of claim 3, comprising a plurality of fluidic die.

7. A replaceable printhead comprising:

a plurality of fluidic die, each fluidic die comprising:

a plurality of actuators, the actuators forming a number of primitives;

a plurality of delay circuits comprising a delay circuit coupled to each primitive;

a digital-to-analog converter (DAC) to drive the delay circuits, the delay circuits delaying a number of activation pulses that activate the actuators associated with the primitives to reduce peak power demands of the fluidic die; and a processing device of the printhead to provide a different signal to each DAC of each fluidic die, each signal being tuned based on an optimal delay for an associated individual fluidic die.

8. The printhead of claim 7, wherein the delay circuits delay each primitive based on a defined print function.

9. The printhead of claim 7, wherein the DAC is a die-global circuit electrically coupled to the delay circuit of each primitive.

10. The printhead of claim 7, comprising a data storage device on the fluidic die, the data storage device storing a number of register bits that control a signal output by the DAC based on a delay setting for each of the primitives.

11. The printhead of claim 7, comprising a number of transistors within each of the delay circuits, wherein the transistors are tuned to an operating point of the delay circuit based on an output signal of the DAC to calibrate the delay circuits relative to the DAC.

12. The printhead of claim 11, comprising a bias voltage generator coupled to the DAC to provide a bias voltage to the DAC, the bias voltage output by the bias voltage generator being tuned based on the operating point of the delay circuits.

13. The printhead of claim 11, comprising a number of compensation devices to compensate for a number of process, voltage, and temperature (PVT) variations within the fluidic die.

* * * * *